US006262535B1

(12) United States Patent
Dierks et al.

(10) Patent No.: US 6,262,535 B1
(45) Date of Patent: Jul. 17, 2001

(54) ELECTRODE SUPPORT TUBE FOR HIGH PRESSURE DISCHARGE LAMP

(75) Inventors: Joern Dierks, Schoenwalde; Dietmar Ehrlichmann, Berlin, both of (DE)

(73) Assignee: Patent-Treuhand-Gesellschaft F. Elektrische Gluehlampen mbH, Munich (DE)

( * ) Notice: Subject to any disclaimer, the term of this patent is extended or adjusted under 35 U.S.C. 154(b) by 0 days.

(21) Appl. No.: 09/290,497

(22) Filed: Apr. 12, 1999

(30) Foreign Application Priority Data

Apr. 24, 1998 (DE) ..... 198 25 004

(51) Int. Cl.[7] ..... H01J 17/18
(52) U.S. Cl. ..... 313/623
(58) Field of Search ..... 313/623, 626, 313/631, 334, 335

(56) References Cited

U.S. PATENT DOCUMENTS 5,140,222 * 8/1992 Roznerski ..... 313/631
5,264,759 11/1993 Lewandowski et al. .
5,304,892 * 4/1994 Lewandowski et al. ..... 313/623
5,569,978 10/1996 Oiye et al. .

FOREIGN PATENT DOCUMENTS 196 18 967 11/1996 (DE) .
196 18 967 A1 11/1996 (DE) .
1 108 772 4/1968 (GB) .

* cited by examiner

*Primary Examiner*—Ashok Patel
*Assistant Examiner*—Todd Reed Hopper
(74) *Attorney, Agent, or Firm*—Frishauf, Holtz, Goodman, Langer & Chick, P.C.

(57) ABSTRACT

The high pressure lamp has a bulb (2) to which a neck (4, 4*a*, 4*b*) is joined. The transition region (6) between the bulb and the neck is conical. A support tube (5, 20, 25) surrounds a holding rod (10) for an electrode (11) within the bulb. The support tube is melt-connected to the neck, and conical with an inner end of the support tube having an outer diameter which is smaller than the outer diameter of the outer end of the support tube. The neck, likewise, is conical, and forms a transition region to the bulb, which is free from the support tube, so that the support tube is recessed within the transition region. This recess is between 3 and 25 mm and corresponds, at the most, to twice the outer diameter of the support tube at its inner end. The ratio of the outer diameter of the outer, or remote, end of the support tube (5, 20, 25) and the outer diameter of the inner, or proximate, end of the support tube is between 1.1 and 2.5.

13 Claims, 2 Drawing Sheets

ELECTRODE SUPPORT TUBE FOR HIGH PRESSURE DISCHARGE LAMP

Reference to related patents, assigned to the Assignee of the present application, the disclosures of which are hereby incorporated by reference:

U.S. Pat. No. 5,140,222, Aug. 18,1992, Roznerski

U.S. Pat. No. 5,264,759, Nov. 23, 1993, Lewandowski et al

U.S. Pat. No. 5,304,892, Apr. 19, 1994, Lewandowski et al

Reference to related patent disclosure:

German DE 196 18 967 A1, Satomi

FIELD OF THE INVENTION

The present invention relates to high pressure discharge lamps, and more particularly to short-arc lamps, especially mercury arc discharge lamps of high power. Additives of metal halides may be included within the discharge vessel of the lamps. The basic principle of the invention is also suitable for use in xenon short-arc discharge lamps.

BACKGROUND OF THE INVENTION

U.S. Pat. No. 5,140,222, Roznerski, discloses a high pressure discharge lamp of the type to which the present invention relates. This lamp has a fill which includes xenon. The lamp has a quartz glass bulb which defines a lamp axis. Two neck portions extend from the bulb in alignment with the axis. The lamp necks are provided with conically shaped support elements made of quartz glass, and with ceramic disks movably located in the lamp necks, and pressed by a spring to a constricted zone of the neck portions and the lamp.

Plug elements in the form of glass cylinders have been used in mercury arc high pressure discharge lamps for support of electrode connecting or holding rods. These glass cylinders are melt-connected to the necks extending from the bulb, and have a smooth generally cylindrical outer surface on which the melt connection is formed. The lamps described in the referenced U.S. Pat. No. 5,264,759, Lewandowski et al, U.S. Pat. No. 5,304,892, Lewandowski et al, and German Publication DE 196 18 967 A1 have such support tubes which, at least in the transition region to the bulb, have a constant wall thickness throughout their length. Thus, the outer diameter as well as the inner diameter of the support tubes are defined by the diameter of the foil melt connection in the more remote portion of the necks of the lamps. The support tubes usually were fitted directly at the beginning of the neck portion, and melt connected with the wall of the bulb in the region of the neck. This technology permitted only mercury fills up to a maximum of 20 mg/cm$^3$ and relative small bulb dimensions, to an overall length of about 80 mm. If higher pressure is used, the risk of bursting increases, since the stress accepting capability in the region of the transition of discharge space to the neck is exceeded.

SUMMARY OF THE INVENTION

It is an object of the present invention to provide a high pressure discharge lamp which can accept a higher fill pressure without bursting, and typically, to accept a value of operating pressure of from 30 to 70 bar.

Briefly, the support tube is shaped to have a conical outer surface which tapers in a narrowing direction towards the interior of the discharge space, that is, towards the respective electrode. The terms "inner end" and "outer end" will be used hereinafter with respect to the discharge space within the bulb of the lamp. Thus, the outer diameter at the inner end of the support tube will be smaller than the outer diameter of the support tube at the outer end thereof. The support tube is melt-connected to the respective neck of the lamp which, in the region of the support tube, is also slightly conical to closely fit the support tube.

The lamp in accordance with the present invention has a bulb of quartz glass with two generally cylindrical necks extending from the bulb. Two electrodes positioned diametrically opposite each other are located within the discharge space of the bulb. The electrodes are supported by electrode holding or support rods. At least one of the holding rods, and preferably, both holding rods, are surrounded by a respective support tube in the inner region of the neck; the support tube, as noted, has a conical outer surface, and is melt-connected to the neck. The outer diameter of the inner end of the support tube is smaller than the outer diameter of the more remote or outer end of the support tube.

The electrode holding rod can continue into the more remote portion of the neck, or it can terminate behind the support tube, for example at a molybdenum disk. The rods can be extended by an extension portion toward the outside. That, however, does not form part of the present invention and the further electrical connection can be in accordance with any well known arrangement, for example as described in the above-referred-to referenced U.S. patents.

The support technology in accordance with the present invention permits constructing higher powered lamps with a power of over 1 kW and a fill which operates under particularly high operating pressure, for example up to about 70 bar. Typically, a mercury fill with 20 to 100 mg/cm$^3$ can be used, rising even to a maximum of up to about 150 mg/cm$^3$. The large bulbs have a length up to 120 mm, and over, and the diameters are typically of about 100 mm.

The danger of bursting of the bulb exists due to the high operating pressure and is counteracted by the practice of this invention. A careful analysis of bursts of bulbs has shown that there is a weak point at the transition between the discharge space of the bulb and the bulb neck. Shaping the support tube in conical form, preferably with essentially uniform wall thickness, surprisingly, substantially reduces the danger of bursting. Utilizing selected dimensioning, readily determinable by a few experiments, the bursting pressure can be increased up to about 300% over previously believed permissible pressures.

In a preferred embodiment of the invention, the ratio between the outer diameter of the remote or rearward end—with respect to the discharge space of the bulb—and the outer diameter of the inner end of the support tube is between about 1.1 and 2.5.

In accordance with an important aspect of the invention, the wall thickness of the support tube at its inner end is as small as possible, so that the transition of the wall thickness of the neck to the system neck-support tube is as continuous as possible. Good results have been obtained when the wall thickness of the support tube is not over the original wall thickness of the bulb at the transition region; preferably it is less and, most preferred, less than 50% of the original wall thickness of the bulb at the point where the support tube starts. With a 50% wall thickness of the support tube, the reinforced wall thickness will be at the most 1.5 the original wall thickness of the bulb after melt sealing the support tube to the neck and/or to the bulb, respectively. The transition zone of the neck, in the region of the inner end of the neck where it joins the bulb, is preferably free from the support tube. It is recommended that this transition zone at the most is twice the outer diameter of the support tube at its inner end. Absolute values, preferably, place this recess of the support tube in the transition zone, or the transition zone itself, between 3 and 25 mm.

The resistance against bursting is further improved and optimized by carefully selecting the cone angle of the bulb in the region of the transition zone to the conical outer surface at the inner end of the support tube. The angle β (FIG. 3) between the end facing surface of the support tube and the inner wall of the bulb, in the region of the transition zone, should be at the most 90°. Preferably at the most it is equal to an angle α, in which the angle α is the angle which corresponds to a tangent on the inner wall of the bulb to the end facing surface of the support tube. The most preferred relationship for the angle β is less than or equal to (α−15°). The inner wall of the bulb, in the region of the transition zone, then typically extends inwardly over the support tube, so that the support tube is recessed from the bulbous region of the bulb.

The concept of a conical support tube does not require that the generatrix for the conical surrounding surface is a straight line; rather, the generatrix for the cone may be a curve, for example a bulged curve, so that the conical surface is somewhat bulged outwardly but, in general, still is generally conical. The generally conical support tube may, at its outer end, have a short cylindrical extension portion extending, preferably, at the most over 30% of the overall length. This cylindrical portion then, of course, will have a constant diameter. The function of the conical portion of the support tube, however, is not affected thereby, and this cylindrical extension portion does not contribute to the operative function in accordance with the present invention.

The most important use of the present invention is in connection with bulbs having a fill including mercury, in which the fill may contain up to 150 mg/cm$^3$, typically between 30 to 100 mg/cm$^3$. Typical power ratings of the lamps are at least 1 kW.

The increase in pressure made possible in accordance with the present invention is obtained by better geometric matching of the wall thicknesses at the transition between the bulb wall and the wall of the neck portion reinforced by the support tube. This arrangement then permits to conically constrict the neck portion at this transition. Preferably, the support tube has a maximum outer diameter up to about 20 mm, most preferably up to about 15 mm at the maximum outer end thereof. Overall, thus, a smaller diameter and, hence, a smaller outer surface in the inner region of the neck has been obtained, which increases the resistance to bursting and, hence, the bursting pressure. The connection between the neck and the support tube is obtained by the well known process of melting-on the neck on the support tube which is narrower at its inner end.

The recess in the transition zone provides for improved distribution of the stresses in the neck portion arising due to the inner pressure of the fill. The neck is a sensitive region of the lamp. It has been found that the resistance to bursting and the stability of pressure acceptance of the neck increases with the relationship of wall strength to diameter of the neck. With a given wall thickness for the bulb, increased stability and bursting resistance is obtained by decreasing the diameter at the connecting point which, in turn, can be obtained by shaping the support tube in conical form with the narrower portion of the conical region facing the interior of the lamp.

DETAILED DESCRIPTION

Figure 1:
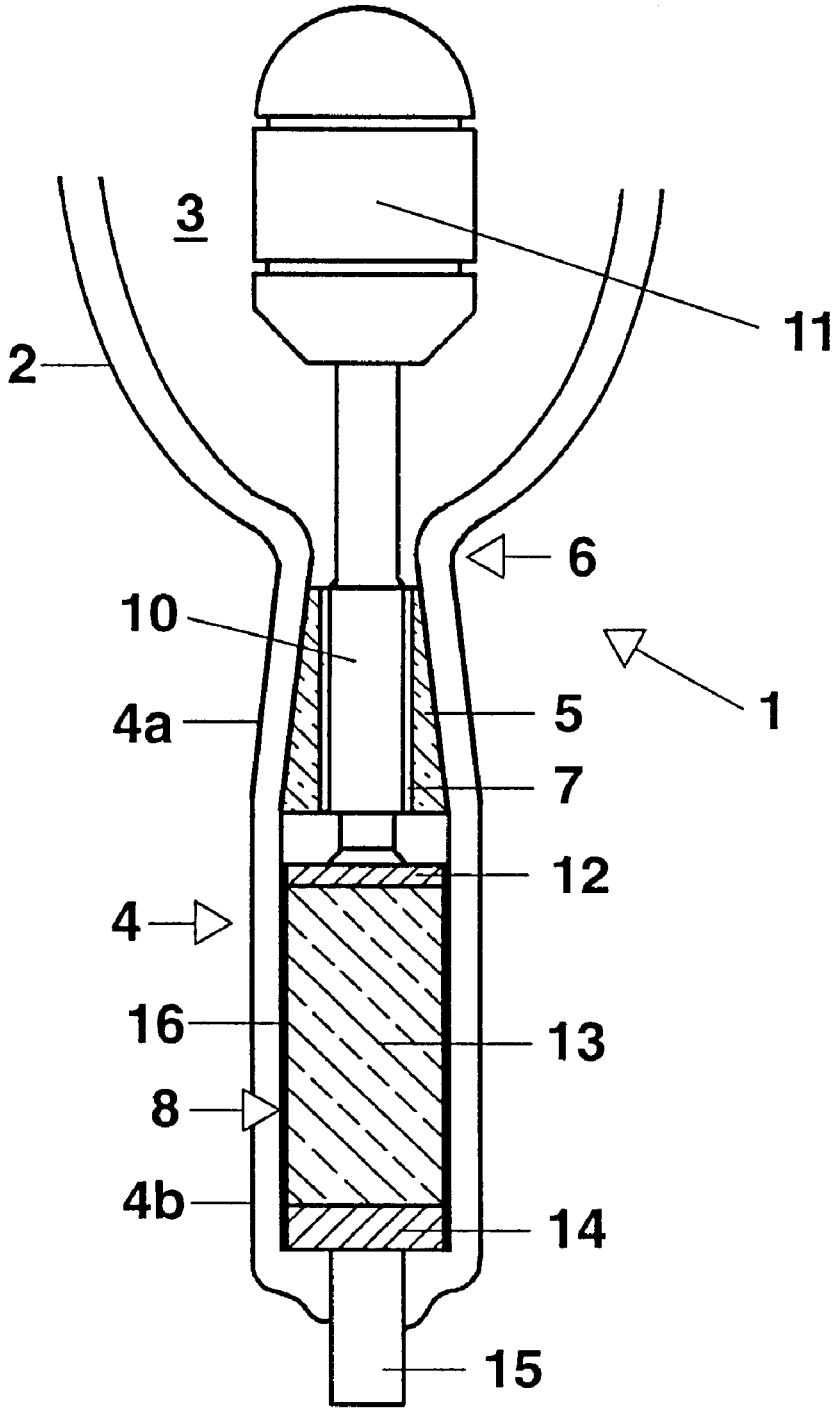
FIG. 1 is a highly schematic partial view of a mercury high pressure arc lamp, in vertical section, in which elements not necessary for an understanding of the present invention have been omitted.

FIG. 1 is a fragmentary view of a 2.5 kW mercury high pressure discharge lamp 1. The lamp has a bulb 2 of quartz glass. The quartz glass has a wall thickness of 4 mm. The bulb is essentially elliptical, or barrel shaped, or otherwise suitably shaped to enclose a discharge space 3. Two necks 4, typically also of quartz glass, extend from the bulb 1; only one of them is shown. In the description and claims, the term "inner" will refer to the region adjacent the discharge space 3, and the term "outer" will refer to the region remote from the discharge space 3. The neck 4 has an inner conical portion 4*a*, which has a support tube 5 therein. Tube 5 is made of quartz glass. The outer portion of the neck 4 terminates in a cylindrical part 4*b* in which the sealing melt connection 8 is formed. The inner part 4*a* has a transition zone 6 of 5 mm length. The support tube 5 is located in this inner part 4*a*, recessed by the said 5 mm from a theoretical closing line of the bulb 2. The tube 5 has a bore or opening 7 through which an electrode support or holding rod 10 extends.

In accordance with a feature of the invention, the support tube 5 is generally conically shaped. The inner diameter is 7 mm. The outer diameter at the inner end is 11 mm, and the outer diameter at the outer end is 15 mm. The wall thickness of the neck in this region surrounding the support tube 5 and extending to the bulb 2 is about 4 mm. The support tube 5 has an axial length of 22 mm.

The electrode holding rod 10 is guided through the bore 7 of the support tube 5. The holding rod 10 has a diameter of 6 mm, and extends axially. An electrode head 11 forming an anode is located within the discharge space 3, connected to the holding rod 10. The rod 10 is extended axially outwardly beyond the support tube 5 and terminates in a disk 12. A quartz block 13 joins the disk 12. A second disk 14 is located at the far or outer end of the quartz block 13, which retains a molybdenum rod 15 forming an outer current supply lead. Four foils 16 are located between the outer surface of the block 13 and the inner surface of the neck portion 4*b* of neck 4, to form a continuous current path for the electrode rod 10. The foils 16 are melt sealed in the neck 4.

At the inner end of the support tube 5, the inner wall of the bulb is tangentially carried beyond the surrounding surface of the support tube roughly tangentially, so that β=α. Shaping the support tube 5 in conical form results in an increase in the bursting pressure by at least 200%, in comparison with the prior art. By forming the transition zone 6 as an extension of the conical surface of the support tube 5, with the recess of the support tube 5 from the bulbous form of the bulb 2 further increases the bursting pressure by an additional 100% to about 300% overall with respect to the prior art.

Figure 2:
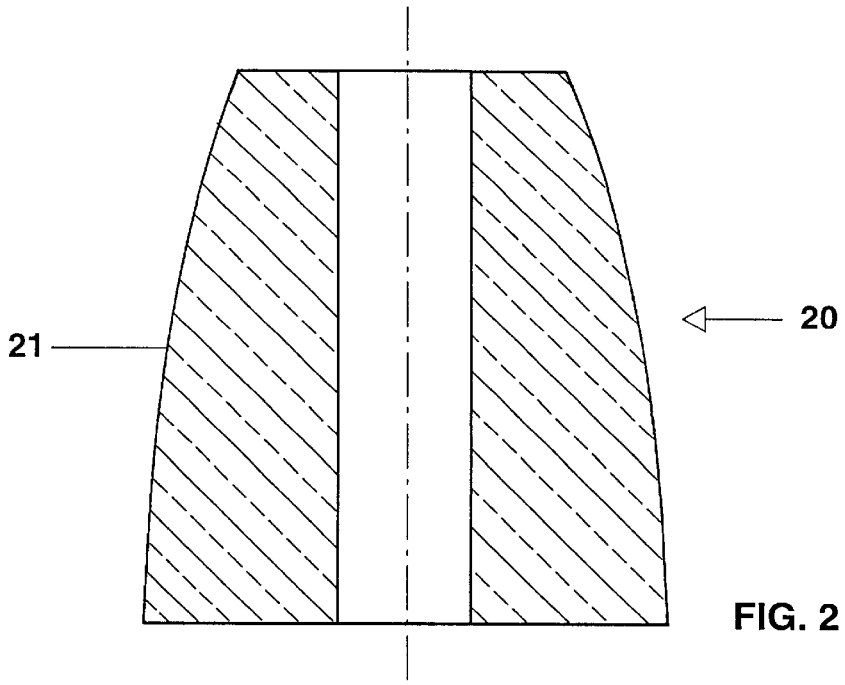
FIG. 2 is an enlarged detail view of another embodiment of a support tube.

FIG. 2 shows a support tube 20, to a greatly enlarged scale, and not to scale, to illustrate an outer, slightly rounded or convexly shaped surface 21. The relationship of the outer diameter at the inner end with respect to the outer end is 1.9.

Figure 3:
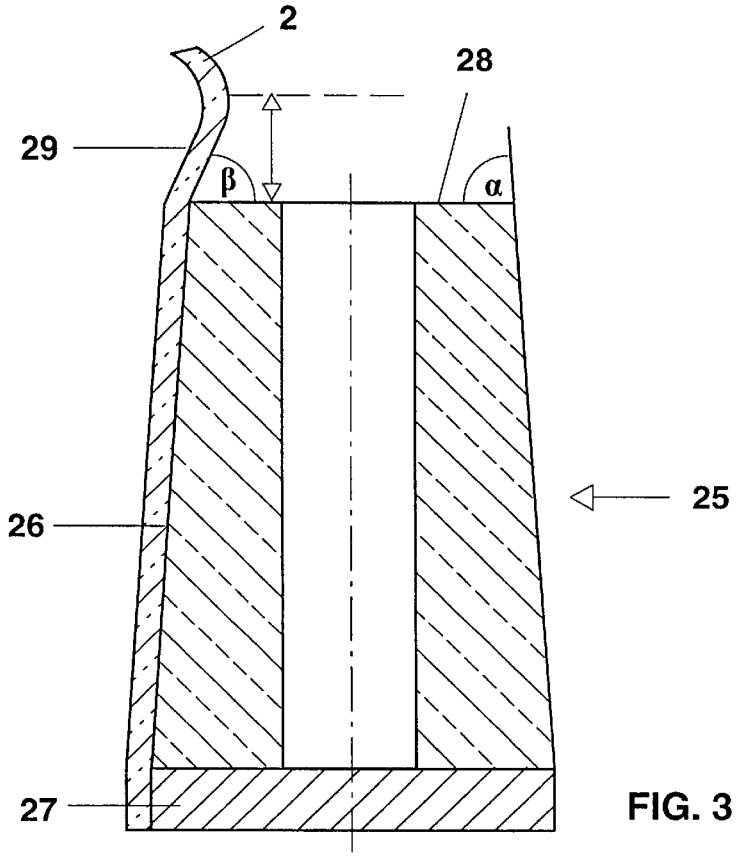
FIG. 3 is an enlarged detail view of a support tube with a cylindrical extension, and also illustrating angular relationships.

FIG. 3 illustrates another form of the invention in which a support tube 25 has an extending cylindrical portion 27 of constant outer diameter. The generatrix for the surrounding surface 26 is a straight line, with a relationship of the outer diameter of the inner to the outer end of 1.4. The length of the cylindrical extension portion 27 is about 10% of the overall length of the support tube 25. At the inner end, where the facing end surface 28 is located, the inner wall 29 of the bulb is so connected to the support tube 25 that it forms an angle of $\beta=70°$ with the end surface 28. The tangential angle $\alpha$ of the support tube 25 is 86°, that is, $\alpha=86°$.

The support tube 5, 20, 25 is made of quartz glass.

Various changes and modifications may be made and any features described in connection with any one of the embodiments herein may be used with any of the others, within the scope of the inventive concept.

What is claimed is:

1. High pressure discharge lamp (1) comprising:

a lamp bulb (2) of quartz glass, and defining a lamp axis;

two electrode necks (4, 4*a*, 4*b*) projecting from said lamp bulb in alignment with said axis;

two electrodes (11) each having a holding rod (10) attached thereto, said electrode rods extending into respective electrode necks; and a support tube (5, 20, 25) surrounding at least one of said holding rods (10) and located adjacent an inner region of the respective electrode neck, wherein, said support tube (5, 20, 25) has a generally conical outer surface which tapers in a narrowing direction towards the respective electrode (11), wherein the outer diameter of an inner end of said support tube is smaller than the outer diameter of the outer end of said support tube; and wherein the support tube is melt-connected with the respective electrode neck (4, 4*a*, 4*b*); and wherein a transition region (6) of the neck (4, 4*a*, 4*b*) and the bulb (2) is devoid of the support tube (5, 20, 25) to form a recess between the inner end of the support tube and an end portion of the bulb.

2. The lamp of claim 1, wherein the relationship between the outer diameter of the outer end of the support tube (5, 20, 25) and the outer diameter of the inner end of the support tube (5, 20, 25) is between about 1.1 and 2.5.

3. The lamp of claim 1, wherein the wall thickness of the support tube (5, 20, 25) at its inner end is at least equal to, and optionally smaller than, the wall thickness of the bulb at an adjacent region of the bulb.

4. The lamp of claim 3, wherein the wall thickness of the support tube (5, 20, 25) at its inner end is less than 50% of the wall thickness of the bulb at said adjacent region.

5. The lamp of claim 1, wherein the recess is at most twice the outer diameter of the support tube at its inner end.

6. The lamp of claim 1, wherein said transition region (6) has a length of between 3 and 25 mm.

7. The lamp of claim 1, wherein the inner wall (29) of the bulb (2) joins the conical outer surface of the support tube (5, 20, 25) at an angle $\beta$, wherein the angle $\beta$ is defined as the angle between the end face (28) of the support tube (5, 20, 25) and the inner wall of the bulb (2) in the region of the transition region; and wherein the angle $\beta$ is at most equal to an angle $\alpha$ and, optionally, smaller than the angle $\alpha$, by up to ($\beta=\alpha-15°$), wherein $\alpha$ is defined as the cone angle of a tangent of the support tube (5, 20, 25).

8. The lamp of claim 1, wherein a generatrix of the conical surrounding surface of the support tube (5, 25) is a straight line.

9. The lamp of claim 1, wherein the generatrix of the generally conical wall surface of the support tube (20) is a bowed or bulged curve (26).

10. The lamp of claim 1, including a fill of mercury within the bulb (2), up to a fill quantity of about 150 mg/cm$^3$.

11. The lamp of claim 10, wherein the power rating of the lamp (1) is at least 1 kW.

12. The lamp of claim 1, wherein said transition region (6) between the bulb and the neck is essentially conical.

13. The lamp of claim 1, wherein the inner region of the neck (4*a*) is conical and extends to a transition region (6) of the neck (4) and the bulb (2) and then merges with the bulb (2).

* * * * *